US005564378A

United States Patent [19]

Rodriguez

[11] Patent Number: 5,564,378

[45] Date of Patent: Oct. 15, 1996

[54] ANTI-RECOIL DEVICE FOR STARTER ROPE

[76] Inventor: Otto M. Rodriguez, 5708 Lost Grove Dr., Lilburn, Ga. 30247

[21] Appl. No.: 530,761

[22] Filed: Sep. 19, 1995

[51] Int. Cl.[6] ..... F02N 3/02

[52] U.S. Cl. ..... 123/185.3; 24/132 R

[58] Field of Search ..... 123/185.2, 185.3, 123/185.4; 24/132 R, 133

[56] References Cited

U.S. PATENT DOCUMENTS

| | | | |
|---|---|---|---|
| 428,374 | 5/1890 | Brodnax | 24/132 R |
| 1,489,117 | 4/1924 | De Paye | 24/132 R |
| 1,969,026 | 8/1934 | Morris | 24/133 |
| 4,005,509 | 2/1977 | Verdina et al. | 24/133 |
| 4,477,947 | 10/1984 | Lyons | 24/133 |

*Primary Examiner*—Andrew M. Dolinar
*Attorney, Agent, or Firm*—James B. Middleton

[57] ABSTRACT

A spring-urged clamp is fixed to an apparatus having a rope-started internal combustion engine. The rope for starting the engine passes through the clamp. The clamp is spring-urged to a closed position, and the jaws of the clamp have teeth angled so that the rope will move easily for starting the engine; but, if the engine attempt to re-coil the rope, the jaws of the clamp will grip the rope and prevent return motion. The clamp has release handles so the rope can be released to be recoiled after the engine has started.

5 Claims, 1 Drawing Sheet

ANTI-RECOIL DEVICE FOR STARTER ROPE

BACKGROUND OF THE INVENTION

1. Field of the Invention

This invention relates generally to safety devices, and is more particularly concerned with an anti-recoil device for the starter rope of an internal combustion engine.

2. Discussion of the Prior Art

Many different powered devices utilize an internal combustion engine that is started by pulling a rope, the rope spinning the engine in order to start the engine. Such devices include lawnmowers, chain saws, rotary tillers, electric power generators, water pumps, blowers and sweepers, and many other forms of apparatus, both domestic and commercial. The engines in these devices range from quite small, fractional horsepower engines to rather large, ten to fifteen horsepower.

When the starter rope of an engine is pulled, there is a clutch that causes the rope pulley to be engaged with the engine to rotate the engine. When the engine cranks, the engine overruns the clutch and disconnects the engine from the rope pulley. It sometimes happens, however, that the engine kicks and attempts to re-wind the starter rope. Usually, the person trying to start the engine is still holding the rope when this happens, and there is some trauma to the person. In minor cases, the person may experience some pain and have a bruise; but, in major cases, the person may experience several broken bones and damaged cartilage in his hand and fingers, and have severe bruises and the like. This more severe injury is known as "Jersey Break", and has been known to medical practitioners for several decades.

Though the above mentioned problem has existed for many years, no solution has been offered other than the electric starter. An electric starter is an excellent solution for large engines, but is both too expensive and too large and heavy for small engines on chain saws, line trimmers and the like where weight is a significant factor. Thus, the prior art has not provided any viable solution to the problem.

SUMMARY OF THE INVENTION

The present invention provides, in combination with a rope-started internal combustion engine, an anti-recoil device for the starter rope. The anti-recoil device is in the form of an automatic clamping device that allows free movement of the starter rope in one direction, but clamps the rope against movement in the opposite direction. Thus, a person can pull the rope in one direction to start the engine, but the engine is prevented from pulling the rope back, in the opposite direction. Preferably the anti-recoil device includes an easy release means to allow the starter rope to recoil after the engine has been started and the rope has been released.

In one embodiment of the invention the anti-recoil device is of a pivoted construction having spring means to hold the handles apart and the jaws together. The jaws have angled teeth for engaging and holding the rope from movement in one direction, while allowing easy movement of the rope in the opposite direction. The handles can be manually urged together to release the rope when desired.

It is contemplated that the anti-recoil device of the present invention will be mounted on, or adjacent to, the engine. Any convenient location for receiving the starting rope will work properly with the present invention.

BRIEF DESCRIPTION OF THE DRAWINGS

These and other features and advantages of the present invention will become apparent from consideration of the following specification when taken in conjunction with the accompanying drawings in which.

DESCRIPTION OF THE EMBODIMENT

Figure 1:
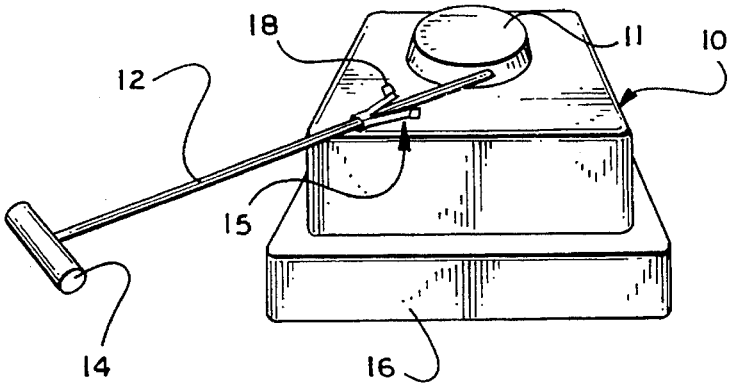
FIG. 1 is a perspective view illustrating an anti-recoil device made in accordance with the present invention mounted on an engine housing.

Referring now more particularly to the drawings, and to that embodiment of the invention here presented by way of illustration, FIG. 1 shows, in rather stylized fashion, an internal combustion engine 10. The engine 10 has a circular housing 11 from which the starter rope 12 extends. As pictured, the rope 12 is extended, and it can be seen that the rope 12 terminates in a handle 14.

It will be understood by those skilled in the art that the engine 10 may be any specific brand of engine, and different engines are differently arranged physically, while being substantially the same in construction and operation. Also, with some apparatus, the starter rope 12 will be operated directly at the engine 10 as here shown. In other apparatus the starter rope 12 may be somewhat remote from the engine 10. For example, on a lawnmower, the handle 14 may be located on the handle of the lawnmower. All such structures are equivalent to that shown, the important feature being the inclusion of the anti-recoil device 15 between the handle 14 and the engine 10.

The engine 10 is here shown as mounted on a stylized apparatus 16. The apparatus 16 is shown simply as a rectangular device, but such device may be any piece of equipment to be driven by an engine.

In FIG. 1 of the drawings it can be seen that the anti-recoil device 15 is fixed to the engine 10 between the handle 14 and the housing 11 from which the rope 12 extends. The rope 12 passes through the anti-recoil device 15, and through guides which will be discussed in more detail hereinafter. The construction is such that the rope can move freely for the handle 14 to be moved away from the housing 11, the direction to start the engine; but, the anti-recoil device 15 prevents movement of the rope in a direction to allow the handle 14 to move towards the housing 11. However, the release handles 18 can be moved to release the rope 12 and allow the rope to recoil into the housing 11 to be ready for the next start.

Figure 2:
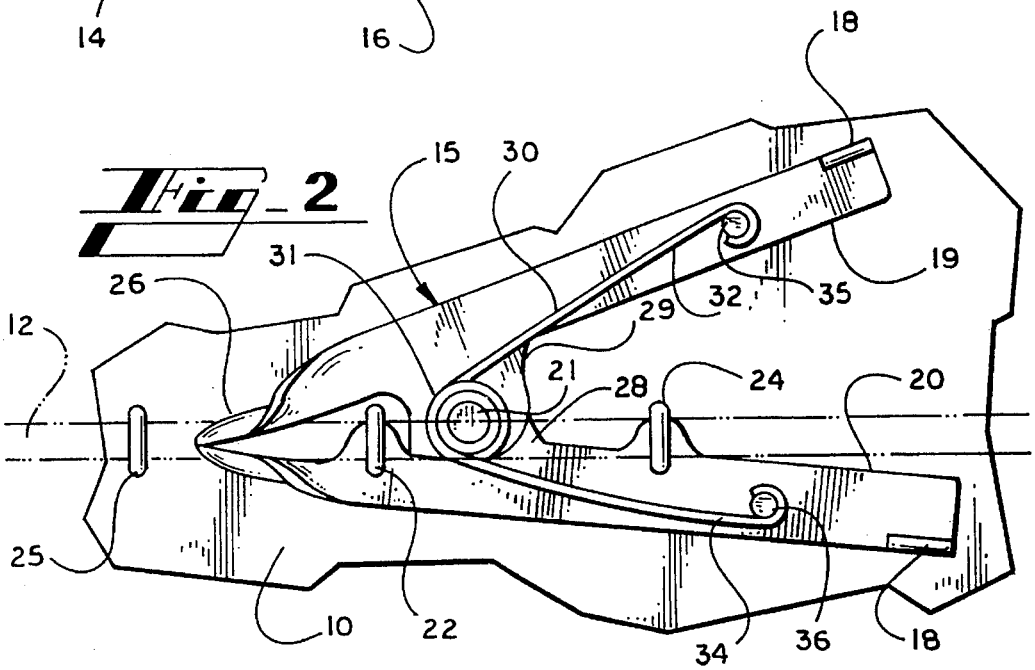
FIG. 2 is an enlarged, top plan view of the anti-recoil device shown in FIG. 1.
Figure 3:
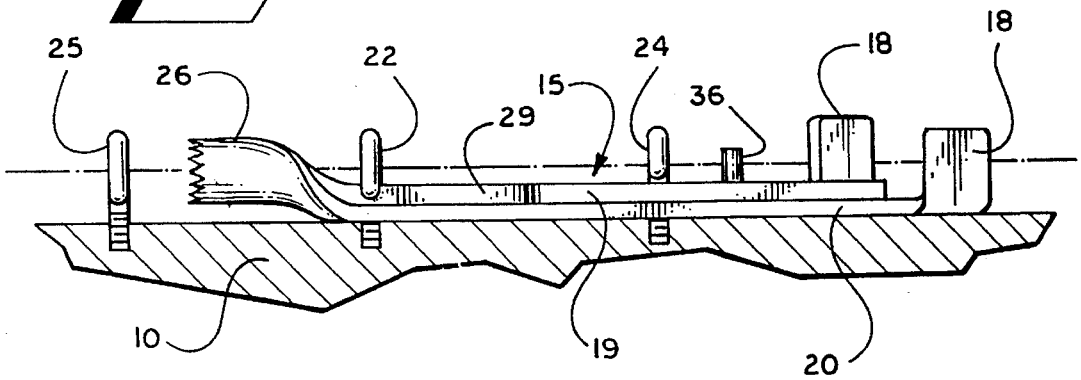
FIG. 3 is a side elevational view of the device shown in FIG. 1, some of the parts being omitted for clarity; and, FIG. 4 is an enlarged, fragmentary view showing the gripping jaws of the device shown in FIG. 1.

Attention is now directed to FIGS. 2 and 3 for a better understanding of the structure of the device of the present invention. The engine 10 is shown only fragmentarily, and it will be understood by those skilled in the art that the engine 10 represents any mounting surface for the anti-recoil device 15. As is discussed above, the device 15 can be mounted anywhere convenient, and the arrangement here shown is merely by way of illustration.

The anti-recoil device 15 includes opposed members 19 and 20 which are pivoted together at 21. As here shown, the member 20 is fixed to the engine 10. For convenience, the means for fixing the member 20 to the engine 10 also comprises guide means for the rope 12. The member 20 defines holes therethrough, and screw eyes 22 and 24 pass through the holes in the member 20, and into the engine 10 or its housing. In FIG. 2, the screw eyes 22 and 24 are shown as being threaded directly into the engine 10. It will be understood, however, that the screw eyes may pass through a housing of the engine or the like and receive nuts on the opposite side of the housing.

In order to be sure the starter rope 12 is well controlled, and remains in the proper area for gripping by the anti-recoil device 15, there is preferably an additional rope guide 25 adjacent to the jaws 26 of the device 15. The use of the guides, such as the guides 22, 24 and 25, and the location thereof, is variable, depending on the specific set up; but, those skilled in the art will understand the intent and readily place guides as is appropriate.

The member 20 of the device 15 has an extension 28 that is complementary to an extension 29 on the member 19. The two extensions 28 and 29 overlap, and receive the pivot pin 21 through appropriate openings. With this construction it will be seen that, when the handle portions of the members 19 and 20 are pivoted apart, the jaw portions of the members are pivoted towards each other. Since the jaws 26 are intended to hold the rope 12 except when intentionally released, a spring means 30 normally holds the handle portions apart.

Looking at FIG. 2, the spring means 30 as here shown includes a coil 31 generally concentric with the pivot 21, and legs 32 and 34 extending down the handle portions of the members 19 and 20 respectfully. Pins 35 and 36 receive the extending ends of the spring means 30, and the legs 32 and 34 are fixed to the pins 35 and 36.

With the above described construction in mind, it will be understood that the anti-recoil device 15 will be mounted adjacent to a rope-started engine, with the anti-recoil device 15 between the handle 14 of the starter rope 12 and the engine 10. When the engine 10 is to be started, one will grasp the handle 14 and pull as is conventional. Because the starter rope 12 passes through the anti-recoil device 15, in the event the engine attempts to rewind the rope, the rope 12 will be mechanically held to prevent such rewind, and to prevent trauma to the person's hand. After the engine has started, the release handles 18 can be depressed to open the jaws 26 and allow the rope 12 to rewind into the housing 11.

It will be noticed that the anti-recoil device 14 as here shown is made of sheet material that has been stamped or otherwise formed into the desired shape. While this is desirable because of the low expense for manufacture, the same device may be made by other techniques. Obviously, the members 19 and 20 may be cast, forged, or otherwise formed.

Figure 4:
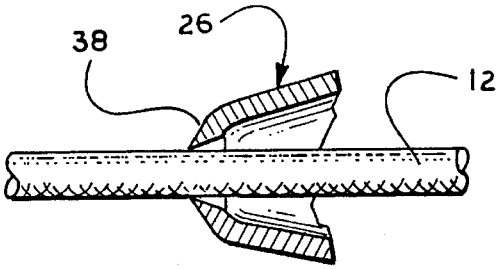

With attention directed specifically to FIG. 3 and 4, it will be seen that the jaws 26 are angled inwardly as at 38. This construction allows the rope 12 to move easily for starting the engine, which is to the left as viewed in FIGS. 2 and 3. When the rope attempts to move in the opposite direction, however, the jaws 26 will dig into the rope 12 and prevent movement. To assist in holding the rope 12 securely, the jaws 26 may be serrated as shown in FIG. 3. Though smooth jaws 26 may hold quite well, the serrations may be desired if the rope 12 is of a material that is harder to grip securely.

It will therefore be seen that the present invention provides a safety device to prevent inadvertent recoil of the starter rope of an internal combustion engine. A rope gripping means is mounted between the pull-handle and the engine for allowing rope motion in the starting direction, but not in the recoil direction.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. An anti-recoil device for a rope-started, internal combustion engine, wherein said engine includes a starter rope extending along a path from said engine, and a handle fixed to the extending end of said starter rope, said rope being normally movable along said path in a first direction for starting said engine, and in a second, opposite, direction for rewinding, said anti-recoil device comprising clamping means fixed with respect to said engine and mounted along said path between said engine and said handle, said clamping means including means for allowing movement of said rope in said first direction, and means for preventing movement of said rope in said second direction.

2. An anti-recoil device as claimed in claim 1, wherein said clamping means comprises a first member having a handle portion and a jaw portion, said first member being fixed with respect to said engine, and a second member having a handle portion and a jaw portion, said second member being pivotally fixed to said first member, said jaw portion of said second member being located to cooperate with said jaw portion of said first member for engaging said rope extending along said path, and spring means for urging said handle portions apart and said jaw portions together.

3. An anti-recoil device as claimed in claim 2, and further including guide means for guiding said rope along said path, said guide means comprising fastening means for fixing said first member with respect to said engine.

4. An anti-recoil device as claimed in claim 2, said jaw portions defining teeth for gripping said rope, said teeth being angularly disposed with respect to said rope for allowing motion of said rope in said first direction and for gripping said rope against motion in said second direction.

5. An anti-recoil device as claimed in claim 4, and including release handles for urging said handle portions towards each other and said law portions away from each other to release said rope.

* * * * *